United States Patent [19]

Winn, Jr.

[11] 4,048,884

[45] Sept. 20, 1977

[54] FIBER SHEAR SYSTEM

[75] Inventor: James Buchanan Winn, Jr., Wimberley, Tex.

[73] Assignee: The Archilithic Company, Dallas, Tex.

[21] Appl. No.: 640,874

[22] Filed: Dec. 15, 1975

[51] Int. Cl.[2] ..... B26D 7/06

[52] U.S. Cl. ..... 83/24; 83/100; 83/199; 83/402

[58] Field of Search ..... 83/199, 402, 24, 22, 83/198, 200, 100

[56] References Cited

U.S. PATENT DOCUMENTS

| | | | |
|---|---|---|---|
| 812,452 | 2/1906 | Richards | 83/200 |
| 3,285,114 | 11/1966 | Johnson, Jr. | 83/402 |
| 3,404,593 | 10/1968 | Arcarese et al. | 83/199 X |
| 3,683,732 | 8/1972 | Juppet | 83/402 |
| 3,693,487 | 9/1972 | Murdock et al. | 83/200 X |
| 3,807,270 | 4/1974 | Wirz | 83/402 X |

*Primary Examiner*—Willie G. Abercrombie
*Attorney, Agent, or Firm*—Richards, Harris & Medlock

[57] ABSTRACT

Control of the flow of fibrous material and selective shearing the material at predetermined lengths is provided by apparatus including a first shear element having an aperture in a plane face thereof and adapted with an input tube for feeding the fibrous material through the aperture in the shear element. A second shear element is rotatably attached to the first shear element and has an aperture in a plane face thereof alignable with the aperture of the first shear element. An egress tube is attached to the second shear element for receiving material from the aperture in the second shear element when aligned with that of the first shear element. The fibrous material is moved through the input tube and out of the egress tube by air pressure when the apertures in the shear elements are aligned. By rotating the first shear element relative to the second shear element, the fibrous material passing through the apertures therein is sheared and the flow of material therethrough stopped.

10 Claims, 4 Drawing Figures

FIBER SHEAR SYSTEM

FIELD OF THE INVENTION

This invention relates to an apparatus and method for selectively shearing fibrous material and more particularly for selectively and automatically interrupting the flow of the fibrous material and simultaneously shearing the material in predetermined lengths.

PRIOR ART

Fibrous material is used in many industrial applications, both as a coating or structural component. The material is often dispensed under pressure from a container housing the fibrous material in the form of a continuous roving or chord. Depending on the application of the fibrous material, it is frequently necessary to shear the fibrous roving in preselected lengths as required by the particular use.

The prior art methods of shearing fibrous material as it is dispensed have involved the use of a knife member which is passed through the flow path of the fibrous material as it moves through the dispensing device. In these apparatus, cutting is achieved by shearing the fibrous material against supports on each side of the knife member.

While these forms of shearing apparatus have met with some success in the field of application of fibrous materials to which the present invention is directed, the prior art systems embodying the basic concept of the use of a cutting knife have all been burdened by requiring the extra knife element. Additionally, the prior art systems have required mechanical actuation of the cutting element.

SUMMARY OF THE INVENTION

In accordance with the present invention, there is provided an improved fibrous material projection apparatus and method which eliminates the traditionally employed knife element by moving the downstream portion of the flow channel relative to the upstream portion to accomplish shearing of the fibrous material passing therethrough. The present invention further provides for the automatic shearing of the fibrous material in predetermined lengths.

In accordance with one aspect of the invention, the apparatus for controlling the flow of fibrous material and selectively shearing the material includes a first shear element having an aperture in a plane face thereof with an input tube attached thereto for feeding the fiber through the aperture. A second shear element is rotatably attached to the first shear element and has an aperture in a plane face thereof alignable with the aperture in the first shear element by rotating the second element relative to the first. An egress tube is attached to the second shear element for receiving the fiber from the aperture therein when the apertures in the first and second shear elements are aligned.

Means are provided for moving the material through the input tube and out of the egress tube when the apertures in the first and second shear elements are aligned. Further, means for automatically and preselectively rotating the first shear element relative to the second shear element are provided whereby the fibrous material passing through the apertures is sheared by the relative movement therebetween and the passage of the material from the input tube to the egress tube is automatically stopped.

In accordance with another aspect of the invention, a fibrous roving is moved through the input tube and out of the egress tube by injecting air into the egress tube to create a low pressure area for drawing the roving from the input tube through the egress tube. Additionally, the rotation of the first shear element relative to the second shear element is accomplished by the energization of a solenoid communicating with the first shear element.

In accordance with one embodiment of the invention, a switch is provided for selectively energizing the solenoid and includes a timer for automatically actuating the solenoid to systematically shear the roving into predetermined lengths as it passes from the input tube to the egress tube.

The novel features believed characteristic of the invention are set forth in the appended claims. The invention itself, however, as well as further objects and advantages thereof, will best be understood by reference to the following detailed description of an illustrative embodiment taken in conjunction with the accompanying drawings, in which:

DESCRIPTION OF THE PREFERRED EMBODIMENTS

Figure 1:
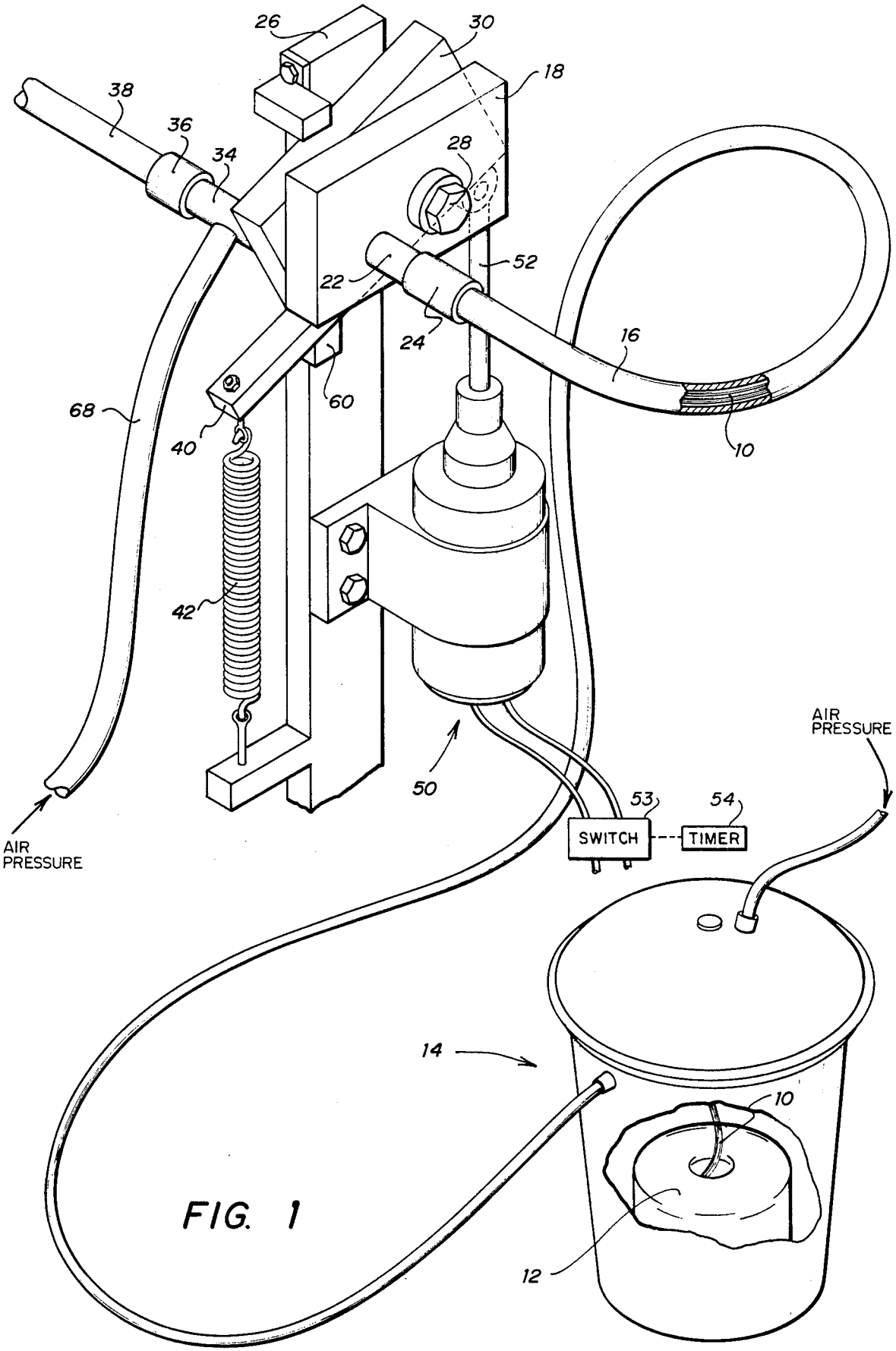
FIG. 1 illustrates a perspective view of a preferred embodiment of the present invention.
Figure 2:
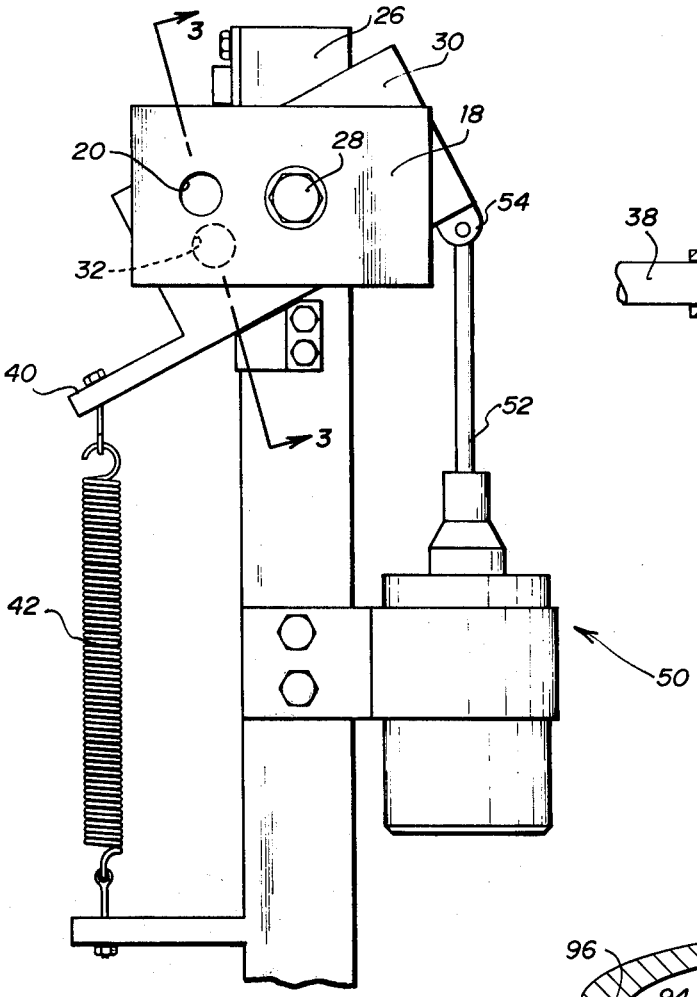
FIG. 2 is a side elevational view of the embodiment of FIG. 1.

FIG. 1 illustrates a perspective view of the system of the present invention for delivering fibrous material or continuous fiber roving 10 from a suitable spool 12 generally contained in a pressurized container 14. The fibrous roving 10 is threaded through an input tube or pipe 16 leading from pressurized container 14. A main function of the present system is to provide the capability of cutting the fibrous roving 10 and stopping the flow thereof at any desired time either mechanically or automatically. For this purpose, a shear element 18 is provided with an aperture 20 and a tubular extension 22 extending from aperture 20. As is best seen in FIG. 2, aperture 20 may be partially tapped to accept the threaded end of extension 22. The aperture is only partially threaded to prevent the extension 22 from passing through the shear element 18. Alternatively, the aperture 20 within shear element 18 may be slightly tapered to accept extension 22 by press fit while preventing the extension from passing through shear element 18. Tubular extension 22 is connected by way of coupling 24 to input tube 16 thereby providing a passageway for roving 10 to aperture 20 in shear element 18. Shear element 18 is fixedly attached to a frame 26 by a pin 28.

A second shear element 30 is positioned between frame 26 and shear element 18 and is rotatable about pin 28 relative to stationary shear element 18.

Figure 3:
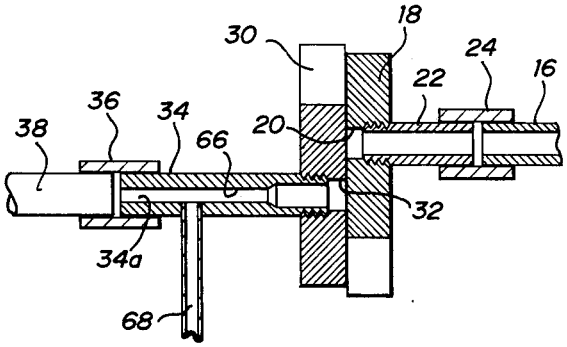
FIG. 3 is a sectional view taken along lines 3—3 of FIG. 1 looking in the direction of the arrows.

As is best seen in FIGS. 2 and 3, shear element 30 is adapted with an aperture 32 from which an egress tube or nozzle element 34 extends. The method of joining nozzle element 34 to shear element 30 is identical to that used to join extension 22 to shear element 18, care being taken not to permit the extension to protrude through shear element 18. Nozzle element 34 is joined by coupling 36 to delivery tube 38. Shear element 30 is further provided with an extension arm 40 extending longitudinally therefrom and adapted for receiving a spring 42.

Spring 42 is secured between arm 40 and frame 26 and tends to rotate element 30 about pin 28. A stop element 60 is attached to frame 26 to limit the rotation of shear element 30 under the action of spring 42.

A solenoid, indicated generally by the numeral 50, communicates by way of plunger 52 with the end of shear element 30 opposite extension arm 40. As is best seen in FIG. 3, plunger 52 is rotatably coupled to shear element 30 by pin 54 which permits plunger 52 to exert a force on shear element 30 and provides for the corresponding rotation between plunger 52 and element 30. The point of connection between solenoid 50 and plunger 52 and shear element 30 is such that the movement of plunger 52 of solenoid 50 rotates shear element 30 about pin 28 in the direction opposite to the rotation of shear element 30 by tension spring 42. An upper stop assembly 64, attached to frame 26, limits the rotation of shear element 30 by solenoid 50 such that the axis of delivery tube 38 and nozzle element 34 is aligned with the axis of input tube 16. Solenoid 50 is appropriately connected to a power source, and a switch 53 and timer 54 is interconnected therebetween for automatic energization and movement of plunger 52. Although an electrically operated solenoid is shown in the drawings, it will be understood that an air operated unit, such as the Stewart Warner unit known as the Stewart Warner Air Motor, may be substituted for the solenoid power unit shown.

Nozzle element 34 has a tapered bore 66 formed therein. Adjacent shear element 30, bore 66 has a diameter equal to that in input tube 16. The bore tapers to a smaller diameter downstream from shear element 30. This constriction in the bore diameter in nozzle element 34 causes the fibrous roving to be compressed as it passes through the nozzle member and exits through the delivery tube 38. Communicating with the aft end of nozzle element 34 is an air injector line 68 for feeding a flow of air from a pressure source (not shown) into the aft end of nozzle element 34 at venturi chamber 34*a*.

Figure 4:
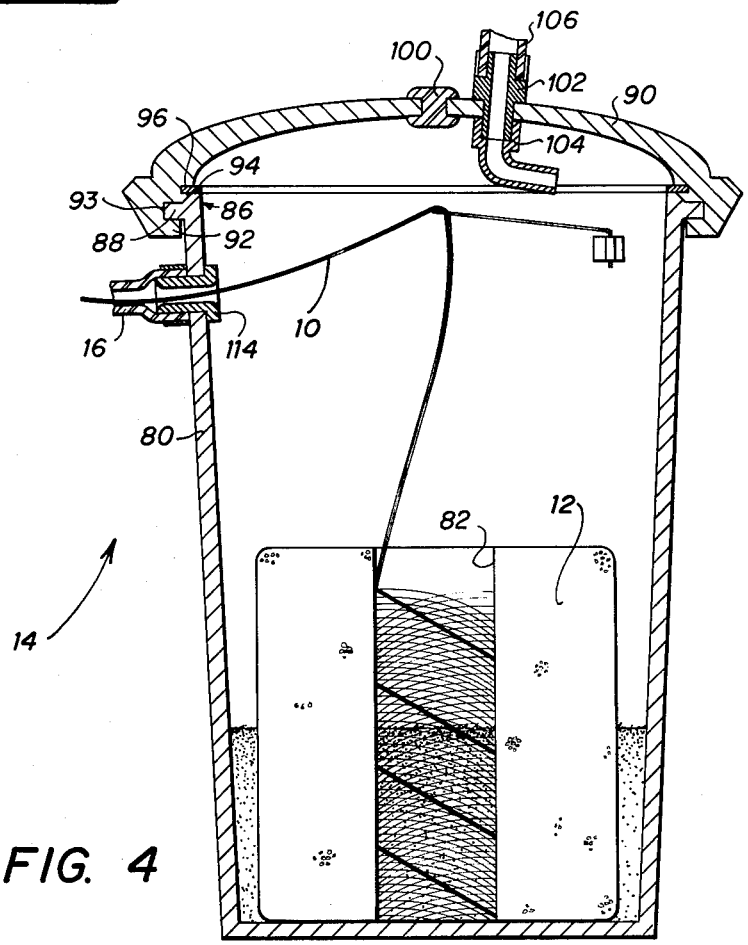
FIG. 4 is a sectional view of the pressurized container 14 shown in FIG. 1.

Referring to FIG. 4, pressurized container 14 includes a relatively deep vessel 80 provided with inwardly sloping shaped walls and a flat bottom for accepting spool 12 therein. The diameter of vessel 80 is preferably larger than the diameter of spool 12 such that the spool may be loaded or unloaded from the vessel with ease. Spool 12 is of the type wherein the supply may be unwound from the inner wall 82 of the spool. The fibrous material or roving 10 will generally be comprised of a bundle of parallel, untwisted, separate strands of glass fibers or the like. Glass fiber rovings are commercially available in spools of 20, 30, 100 or 200 strands. The roving used will generally be dictated by the particular application made thereof.

The vessel 80 is provided with an upper shoulder 86 having an outwardly extending segmented rib 88 for mating with a locking means provided on lid 90. More particularly, lid 90 is provided with a segmented, inwardly extending rib 92 which forms an annular groove 93 for accepting segmented rib 88. A gasket 94 is provided in an annular recess 96 in the lid 90 so that, when the lid is locked onto vessel container 80, the gasket will bear on the upper shoulder 86.

The lid is provided with a blow-out gasket or plug 100. The construction of the plug will be dependent on the pressures to be employed in the system. Also extending through the top of lid 90 is structure forming a flow channel. More particularly, a threaded bushing 102 is threaded into lid 90 and a fitting 104 is secured onto threaded extension of bushing 102 inside the lid. A supply line 106 engages bushing 102 exteriorly of lid 90 and introduces compressed air or gas into vessel 80.

A roving guide 110 is provided in the upper region of vessel 80. The guide may be a single member with an opening therein to direct roving 10 or may be a V-shaped yoke extending from the walls of vessel 80. The fibrous material or roving 10 is threaded through the guide and then extends through an outlet bushing 114 which is threaded into the wall of vessel 80. A flexible line 16 is secured to and extends from the portion of bushing 114 exteriorly of vessel 80. Bushing 114 is provided with a central flow channel through which the fibrous material or roving 10 passes. The bushing is formed with a faired or rounded entry for facilitating the movement of the fibrous material therethrough with a minimum of wear or friction. The fibrous material 10 then courses through input tube 16 to the shearing assembly.

In operation, tension spring 42 acts through arm 40 to rotate shear element 30 downwardly against stop element 60 attached to frame 26. When solenoid 50 is energized, plunger 52 of solenoid 50 is retracted and rotates shear element 30 so that the axis of delivery tube 38 and nozzle element 34 is in alignment with the axis of input tube 16. In this relationship, compressed air in container 14 moves into input tube 16 and through the aligned apertures in the shearing element exiting through delivery tube 38. The movement of air along this course from container 14 serves to draw fibrous material or roving 10 along the same course. Additionally, the effect of air flow through air injector line 68 into venturi chamber 34*a* creates a low pressure area inside nozzle 34 causing fiber roving 10 to be sucked through tube 16 passed nozzle 34 and out delivery tube 38.

In response to the de-energization of solenoid 50, as controlled by the timer interconnected between solenoid 50 and its power source or a suitable manual override, plunger 52 is no longer withdrawn into solenoid 50 and spring 42, acting through arm 40, rotates shear element 30 about pin 28 relative to shear element 18. As is seen in FIG. 2, the action of the mating edges of apertures 20 and 32 of shear elements 18 and 30, respectively, results in the shearing of fibrous roving 10 and the blocking of any continuous flow of roving 10 through the system. The two shear elements are preferably constructed of case hard tool steel such that the mating edges may be sharpened, if desired, to assist in the cutting step. The stoppage of material flow is a result of breaking the communication of the low pressure area existing in venturi chamber 34*a* as well as the sealing of the end of input tube 16 by the body of shear element 30 thereby blocking the passage of compressed air from container 14. The sheared material is ejected through delivery tube 38 which delivers the prepared material to the point of application. By simply energizing solenoid 50, the cycle is repeated by the realignment of the axes of the nozzle element 34 and the input tube 16 through the relative rotation of shear elements 18 and 30 and the apertures therein.

Through empirical data, the rate of flow of fibrous roving through delivery tube 38 may be readily determined and by activating solenoid 50 at predetermined time intervals the length of fibrous material or roving may be controlled. The length of material may be adjusted by increasing or decreasing the time interval between successive energization of solenoid 50 or by increasing or decreasing the flow rate of material through delivery tube 38 by varying the air pressure through venturi chamber 34*a*. Of course, the lengths of the fibrous roving may be adjusted by a combined alteration of the timing actuation of solenoid 50 and the pressure supplied through chamber 34*a*. Similarly, by providing a manual override control to solenoid 50, an operator may selectively alter the actuation to vary the lengths of material ejected by the system.

Thus, the present invention describes a system for delivering fibrous material or roving and selectively or automatically shearing the material in preselected lengths by the control of the movement of rotating shear elements through the action of a solenoid and spring combination. The system is the essence of economy in that it eliminates the additional knife element found in previous systems and accomplishes the shearing step by the relative movement of the upstream portion of the delivery channel relative to the downstream portion. The system further automatically stops material flow with each shear step and is readily adaptable for sequential, preselected automatic shearing of fibrous material to produce any desired length of material.

Whereas the present invention has been described with respect to specific embodiments thereof, it will be understood that various changes and modifications will be suggested to one skilled in the art, and it is intended to encompass such changes and modifications as fall within the scope of the appended claims.

What is claimed is:

1. An apparatus for controlling the flow of fibrous material and selectively shearing the material which comprises:

a first shear element having an aperture in a plane face thereof, an input tube attached to said first shear element for feeding the fibrous material through the aperture in said first shear element, a second shear element rotatably attached to said first shear element and having an aperture in a plane face thereof alignable with the aperture in said first shear element with the plane faces in confronting relation, an egress tube attached to said second shear element for receiving the material from the aperture in said second shear element when the apertures in said first and second shear elements are aligned, means for moving the fibrous material through said input tube and out of said egress tube when the apertures in said first and second shear elements are aligned, and rotation means for rotating said second shear element and said egress tube relative to said first shear element to shear the material passing through the apertures in said first and said second shear elements and to stop the flow of material therethrough.

2. The apparatus of claim 1 and further comprising:

means for normally aligning the apertures in said first and second shear elements to permit movement of the fibrous material from the aperture in said first shear element through the aperture in said second shear element.

3. The apparatus of claim 2 wherein said rotation means comprises:

spring means communicating with said second shear element for rotating said second shear element relative to said first shear element to shear the fibrous material passing through the apertures therein.

4. The apparatus of claim 3 wherein said aligning means comprises:

a solenoid with an actuatable plunger, said plunger communicating with said second shear element, a power source electrically connected to said solenoid for supplying power thereto, and switch means for selectively actuating the plunger of said solenoid by said power source to rotate said second shear element relative to said first shear element to realign the apertures therein for continued flow of fibrous material therethrough.

5. The apparatus of claim 1 wherein said egress tube is a nozzle element having a tapered bore therein for compressing said fibrous material as it is moved therethrough.

6. The apparatus of claim 1 wherein the means for moving the fibrous material through said input tube and out of said egress tube comprises structure for injecting air into said egress tube to create a low pressure area drawing the material from said input tube through said egress tube.

7. The apparatus of claim 4 wherein said switch means includes a timer for automatically deactivating said solenoid to permit systematic shearing of the fibrous material by the movement of said second shear element relative to said first shear element under the action of said spring means.

8. A method for controlling the flow of continuous fiber roving and selectively shearing the roving comprising:

passing the roving under pressure into an input tube and through an egress tube closely aligned therewith, shearing the roving by moving the egress tube relative to the input tube and out of alignment therewith, and blocking the end of the input tube when the input tube is misaligned with the egress tube to stop the flow of roving therethrough.

9. The method of claim 8 and further comprising:

injecting air into the egress tube to create a low pressure area for drawing the roving from the input tube through the egress tube when the input tube is aligned with the egress tube.

10. The method of claim 8 and further comprising:

timing the movement of the input tube relative to the egress tube to control the length of the sheared roving resulting therefrom.

* * * * *